United States Patent [19]

Jergenson

[11] Patent Number: 4,638,210

[45] Date of Patent: Jan. 20, 1987

[54] LIQUID METAL ION SOURCE

[75] Inventor: Jerg B. Jergenson, Santa Barbara, Calif.

[73] Assignee: Hughes Aircraft Company, Los Angeles, Calif.

[21] Appl. No.: 720,470

[22] Filed: Apr. 5, 1985

[51] Int. Cl.[4] ..... H01J 1/00

[52] U.S. Cl. ..... 313/362.1; 313/163; 315/111.81

[58] Field of Search ..... 313/10, 163, 230, 232, 313/362.1; 315/111.81; 250/423 R

[56] References Cited

U.S. PATENT DOCUMENTS 3,475,636 10/1969 Eckhardt ..... 313/163 X
4,088,919 5/1978 Clampitt et al. ..... 313/232 X
4,318,029 3/1982 Jergenson ..... 315/111.81
4,318,030 3/1982 Jergenson ..... 315/111.81

FOREIGN PATENT DOCUMENTS 808236 1/1959 United Kingdom ..... 313/362.1

*Primary Examiner*—Stewart J. Levy
*Assistant Examiner*—Joseph W. Roskos
*Attorney, Agent, or Firm*—Wanda K. Denson-Low; A. W. Karambelas

[57] ABSTRACT

Billet (52) of electrically conductive or semi-conductive material has slot (54) therethrough which contains insulator slip (58). In this condition, the ion emitter body (44) is machined with the cylindrical exterior surface (60), conical nose (62) and emitter point (70). The limited electrical path localizes heating under the point (70) and the strong structure of the body permits strong mounting and controlled heat extraction.

20 Claims, 4 Drawing Figures

LIQUID METAL ION SOURCE

BACKGROUND OF THE INVENTION

This invention is directed to a field emission liquid metal ion source which has a point which is resistively heated and which is coated with liquid metal to emit ions.

The first liquid metal ion source described in the literature was designed and developed by Clampitt at Culham Laboratories in England. It is shown in U.K. Pat. No. 1,442,998. Subsequently to that publication, Culham Laboratories marketed liquid metal ion sources of the same general configuration intended for producing ions of copper, silver, gold, bizmuth, lead, tin, indium, gallium, uranium, mercury, silicon, germanium, iron, aluminum, lithium, sodium, potassium, rubidium, and cesium. In the United States, Dublier Scientific marketed a similar liquid metal ion source, and it is believed that all Dublier Scientific sources were made of refractory metals. The early sources with low melting point fuels were radiatively heated via a simple external coil. Later, the sources were oven heated for use with higher melting point materials.

The gas field ionization "hairpin" ion source was originally designed for gas field emission. The heart of the hairpin device is a U-shaped heater wire with a needle welded to the apex of the U. The heater wire is used to clean the attached needle by heating it to cause outgassing. When used with liquid metal, the hairpin ion source works fairly well with noncorrosive fuel materials. L. W. Swanson first used the device as a liquid metal source by applying liquid metal directly to the needle. A number of drawbacks are found. The hairpin device is difficult to make, due to the necessary welding of the needle to the U-shaped heater wire. Since the needle is mounted on the heater wire and the heater wire is employed for structural support of the needle, the ion source lacks stability in the direction perpendicular to the plane of the U-shaped heater wire when the heater wire is heated. In addition, the hairpin source is thermally inefficient and has a poor temperature gradient.

Advances in liquid metal ion sources have been made at Hughes Research Laboratories division of Hughes Aircraft Company. On behalf of Hughes Research Laboratories, Jerg B. Jergenson invented the structures represented in U.S. Pat. Nos. 4,318,029 and 4,318,030. These sources are easy to make, inexpensive and reliable. As a result, considerable advances in the employment of ions from a liquid metal source have been achieved. Ions have been produced from fuel alloys. However, it soon became evident that alloys containing boron attacked the metallic source components used in the construction of the sources illustrated in those U.S. patents. When such liquid metal ion sources are made of non-metallic materials, they are difficult, if not impossible, to make. In addition, the needle may be inefficiently heated and the required temperature gradient may not be achieved when the source structure is made of non-metallic materials.

Boron is one of the most important doping elements for silicon devices. However, fabrication of a metal liquid metal ion source for utilization of liquid boron has been impractical due to the high melting point of metallic boron and the strong corrosive effect of the boron on most metals. To decrease the problems associated with the high melting point of metallic boron, a rhenium needle and eutectic alloys containing boron have been used. However, the lifetime of some sources employing boron containing eutectic alloys have been restricted to about 10–15 hours due to the corrosion of the rhenium emitters.

One group of Japan has attempted to find a boron containing alloy which is non-corrosive, but substantial lifetimes have not been found. See "Liquid Metal Alloy Ion Sources for B,Sb, and Si," by K. Gamo, published in *Journal of Vacuum Science Technology,* Volume 19, No. 9, November/December 1981, pages 1182–1185. Further development work in Japan uses previously developed glassy carbon emitters for liquid metal ion sources and has used such sources with nickel boride as a fuel material. A lifetime of 200 hours for this type of source has recently been quoted. However, it has been admitted that the nickel constituent of the nickel boron alloy corrodes the emitter tip. Such sources have been used as an ion source in a massseparating column for ion implantation. This is discussed in a publication "Mass-Separated Microbeam System with a Liquid-Metal-Ion Source," by T. Ishitani, et al. published in *Nuclear Instruments and Methods in Physical Research,* Volume 218 (1983) pages 363–367. The entire disclosure of this background material is incorporated herein by this reference.

The ion source is a very small and delicate structure. Furthermore, the emission point must be as positively located as possible in order to maintain adequate alignment of the emitted ion beam. Thus, there is a need for an improved field emission liquid metal ion source.

SUMMARY OF THE INVENTION

In order to aid in the understanding of this invention, it can be stated in essentially summary form that it is directed to a liquid metal ion source wherein a field emission point is positioned on an electrically conductive or semi-conductive material which is slotted together with a non-conductive material positioned within the slot. The conductive material is continuous around the slot at the nose end of the body, and the nose end is configured to conduct heating current and withdraw heat therefrom in order to maintain optimum emitter conditions.

It is, thus, a purpose and advantage of this invention to provide a liquid metal ion source which relies on a field emission sharp point to cause ion emission into an electric field, with the point being on a slotted body so that the body supplies a support for the point, electrical path for heating the point, electrical separation to provide the electrical path and firm physical support of the point so that it may be readily held in position.

It is a further purpose and advantage to provide a liquid metal ion source of field emission type which is economic of construction as well as of strong construction so that it may be easily manufactured, readily available, and conveniently used, even though it is of small dimensions.

Other purposes and advantages of this invention will become apparent from a study of the following portions of the specification, the claims and the attached drawings.

DESCRIPTION OF THE PREFERRED EMBODIMENT

Figure 1:
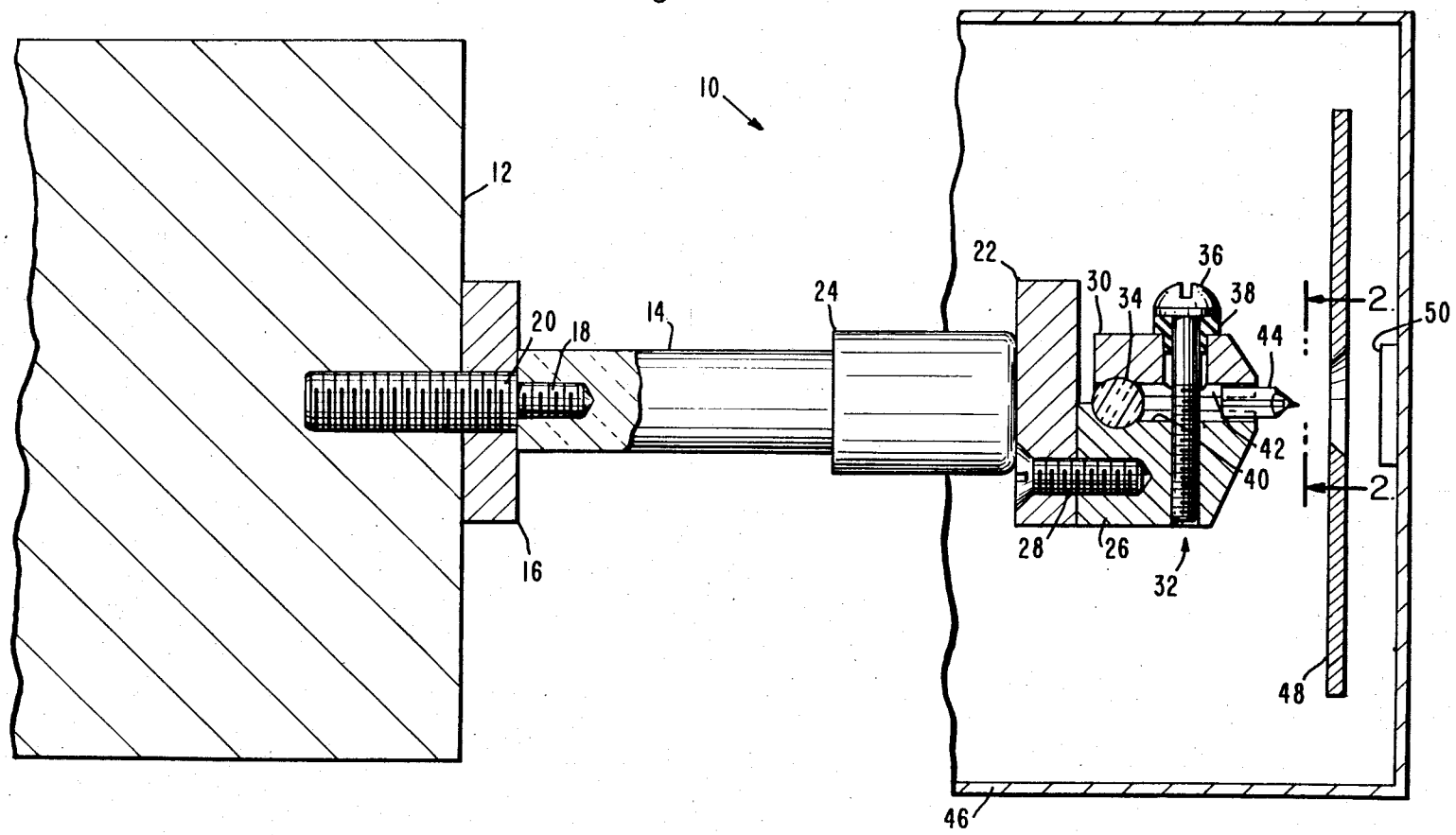
FIG. 1 is a side-elevational view of an ion system which includes the liquid metal ion source of this invention, with parts taken in section and parts broken away.

The ion emitter 44 is shown in detail in FIGS. 2, 3, and 4, and is described in detail below. The ion emitter must be supported in a holder which properly physically positions the emitter over a range of temperatures. In addition, the emitter must be supplied with heater current and bias voltage so that electrical connections are also made to the ion emitter. However, the emitter holder and electrical connections must not provide a thermal load which interferes with the thermal property of the emitter itself. FIG. 1 illustrates a particular holder for a liquid metal ion source 10 which serves as an example of a particular module holder. This holder forms no part of this invention, but is depicted merely in the context of showing one (out of many) ways in which the ion emitter 44 of the invention may be held in position.

Mounting base 12 is part of the liquid metal ion column. Ceramic insulator stand 14 is secured to mounting base 12 through foot 16. Screw 18 secures insulating stand 14 on foot 16, while screw 20 (which has its head broken away in FIG. 1) secures foot 16 to base 12. One, two or three insulator stands may be provided so that clamp base 22 is securely and rigidly mounted. Appropriate screws pass from right to left through clamp base 22 into the insulator stand 14 to provide security. A cup-shaped metallic sputter shield 24 may embrace the right end of insulator stand 14, as shown. In the example shown, clamp base 22 is metallic, as is fixed jaw 26. Screw 28 mounts the fixed jaw to clamp base 22.

Movable jaw 30 of body carrier 32 swings with respect to fixed jaw 26 on pivot 34. Pivot 34 is a cylindrical ceramic pin which lies in partially cylindrical recesses in both jaws, with the axis of the surfaces of the recesses perpendicular to the sheet in FIG. 1. Clamp screw 36 is metallic, but has insulator washer 38 under its head. The washer is preferably ceramic. In this way, movable jaw 30 is electrically isolated with respect to fixed jaw 26. Longitudinal groove 40 extends left to right in FIG. 1 and faces upward in the top of fixed jaw 26. Similarly, longitudinal groove 42 is positioned in the lower surface of movable jaw 30 and faces groove 40. The ion-emitting body 44 of this invention is located in those grooves and is clamped by those jaws. The body itself is indicated in more detail in FIGS. 2, 3 and 4 described below.

Should it be thought desirable to reduce the thermal load of the mounting structure 32 on emitter 44, appropriate engineering choices can be made to reduce the thermal loading. This would include reduction in the mass of the mounting structure, increase in thermal resistivity of the mounting structure, and minimization of the mass of the electrical connections. For example, this same general structure could be made of ceramic of high thermal resistivity with just the jaw faces plated for electrical connection. Reduction in mass of the jaw parts and restriction on the thermal path would permit the source to more quickly reach thermal stabilization. Thus, the structure described above and shown in FIG. 1 is one way in which the source module can be supported, and improved support and electrical connection structure may be developed in the future to support the ion emitting body 44 of this invention. In any event, the jaws must be symmetrical. Heat must be conducted away from the source module/jaw interface or else the required temperature gradient across the tip of the module cannot be achieved.

The liquid metal ion source 10, with its ionemitting body 44, is mounted in a vacuum vessel 46 which contains extractor electrode 48. Various types of downstream ion optics can be provided for focusing and/or directing the beam. In the present case, an ion flood is directed toward target 50 which is positioned beyond the central opening in extractor electrode 48. Target 50 may be any ion beam utilization device. In other types of ion utilization, focusing may be required.

Figure 2:
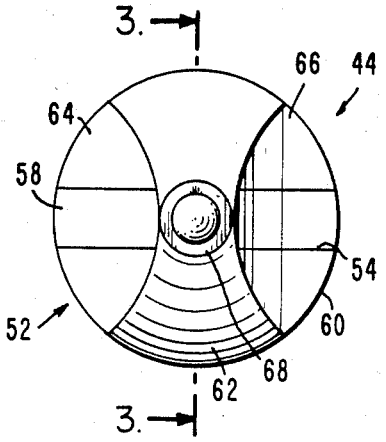
FIG. 2 is an enlarged front-elevational view of the body of the ion source of this invention, as seen along the line 2—2 of FIG. 1.
Figure 4:
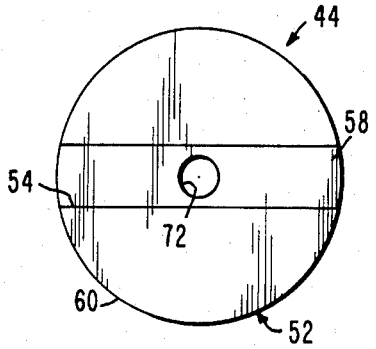
FIG. 4 is a rear-elevational view of the ion source of this invention.
Figure 3:
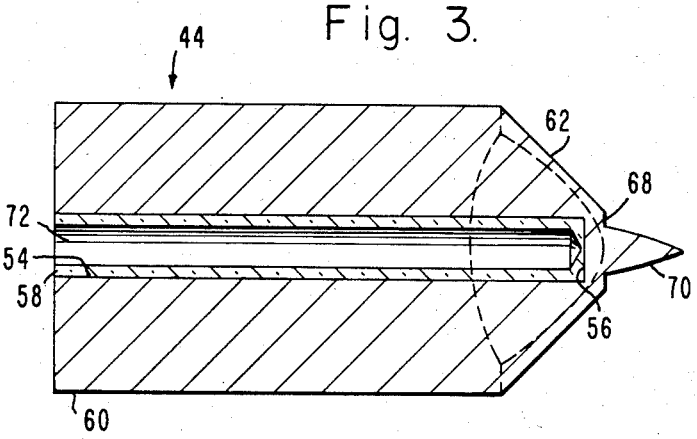
FIG. 3 is a center line section through the body of the ion source as seen generally along the line 3—3 of FIG. 2.

Ion-emitting body 44 which is shown in more detail in FIGS. 2, 3 and 4 is composed of two structural elements. Its structure can be best understood by describing the method in which it is made. A cylindrical billet of the principal material is provided. This principal material is a conductive or semi-conductive material of preferably low thermal coefficient of expansion. In the present preferred embodiment, graphite is used. Other suitable materials for the principal material include boron carbide, boron enriched boron carbide, glassy carbon, titanium diboride, and zirconium diboride. These materials should resist corrosion by the fuel material.

The material is provided in the form of a cylindrical billet, as indicated at 52, having a cylindrical shank 60. Rectangular slot 54 is formed longitudinally and exactly on axis in the billet, but does not reach the end of the billet, which at this stage of manufacture, extends well beyond the tip 70 shown in FIG. 3. Slot face 56 defines the end of the slot.

Insulator slip 58 is placed within slot 54 and is secured therein using, for example, a cyanoacrylic adhesive, also known as "Super Glue," for the purpose of further machining. In the present case where the ion material is boron, a suitable material for insulator slip 58 is boron nitride. The insulating slip is preferably secured in place by a low volume adhesive such as cyanoacrylate. After the slip is in place, cylindrical shank 60 of the billet is then grasped and the tip features are turned (i.e., tip 70, cone 62 and circular face 68). When graphite is used, the tip may be turned on a lathe using a simple high-speed tool bit. Diamond grinding may be required when harder materials are used. During machining, the forward end of the body is turned to become a conical nose 62 with an interior total included area of about 90 degrees. The conical nose surface intersects with the insulating slip so that the electrical bridge connection between the upper and lower portions of the conductive billet portion of the body is fairly narrow in the left-to-right direction in FIG. 2.

In order to further limit the bridge of conductive material at the nose end of the body, surfaces 64 and 66 are formed as cylindrical surfaces about an upright axis in FIG. 2, the module being held in place by cylindrical shank 60. These surfaces intersect conical nose 62 and restrict the electrically conductive bridge between the top and bottom halves of the body. Also, these cylindrical surfaces act to remove the insulative material from the immediate vicinity of the emitter tip. The bridge is as narrow as flat circular face 68 at the forward end of the conical surface. Point 70 is the actual field emission point. The point is made of the body material of the billet, integrally therewith and extends forward from flat circular face 68. The point is substantially a right circular cone preferably with a total included cone angle of 28 degrees. Ion emitter body 44 is formed of a substantially U-shaped electrically conductive or semi-conductive material. Each of the legs which forms the "U-shaped" material is in electrical contact with one of the jaws 30 and 26, and with the bridge connection (as discussed on page 8, lines 30–34). The completed ion emitter body 44 is placed in its holders. FIG. 1 illustrates a holder structure wherein the clamp is formed by the jaws in such a manner that the lower jaw engages the body below the slip and the upper jaw engages the body above the slip. Electrical connections are made to the two jaws to provide electric heating power and positive bias to the ion-emitting body. If it is desired that the temperature of the ion emitter be sensed near its point, bore 72 is provided in the slip of insulator material to extend close to the face 56 so that a thermocouple can be inserted and embedded close to the point.

By this construction, the heated section is very small, but is part of a unitary body. While the adhesive which holds insulator slip 58 in place during machining is burned out during the initial cleaning of the liquid metal ion source, the source module holding mechanism holds the body as a rigid, solid structure. There are no tapes or wires supporting or stressing the body which might cause its repositioning during use. There are no significant dimensional changes of the billet due to temperature changes. The cross-sectional area adjacent and at the smallest part of the bridge form the principal heat-producing part of the electrical path. Away from the point 70, the cross-sectional area dramatically increases in area so that the electrical heating at the point is localized. By adjusting the dimensions of the path adjacent the point, management of temperature and current can easily be accomplished.

After the ion emitter is completed into the form shown in FIGS. 2, 3 and 4, the point 70 is boronized, it is cleaned by heating in vacuum and wetted with boron fluxed fuel material. Suitable fuel include boron platinum alloy, preferably near the eutectic, boron platinum, nickel boride, arsenic palladium and palladium arsenic boron. For a long-life emitter, the emitter materials are chosen with respect to the fuel alloy such that corrosion and alloying between them are minimized.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A body for serving as an ion source, said body comprising:

a billet of electrically conductive or semi-conductive material, said billet having a point end, a back end and sides, a slot in said billet extending from adjacent said point end to said back end and to said sides to separate said billet substantially to said point end into upper and lower portions; and a rigid insulator in said slot to support said upper and lower portions with respect to each other; and a point formed on said billet on said point end, said point being adjacent the end of said slot so that said billet has electrical continuity from said upper portion to said lower portion adjacent said point.

2. The body of claim 1 wherein said body is formed with a substantially symmetrical exterior surface with said point substantially on the axis of said substantially symmetrical surface.

3. The body of claim 2 wherein the end of said body toward said point is a nose and the surface of said nose is substantially conical with a larger total included angle than the included angle of said point.

4. The body of claim 2 wherein the end of said body toward said point is a nose and said nose is partially formed as a concave portion of a cylinder with the axis of the cylinder substantially normal to said slot.

5. The body of claim 1 wherein the end of said body toward said point is a nose and said nose is partially formed as a concave portion of a cylinder with the axis of the cylinder substantially normal to said slot.

6. The body of claim 5 wherein said body is formed with a substantially right circular cylindrical exterior surface with said point substantially on the axis of said substantially cylindrical surface.

7. A liquid metal ion source having a body, said body having a nose end and a back end, said body having a substantially cylindrical exterior surface extending from said back end toward a front end between the back end and the nose end, the nose end extending from the front end towards a point on the tip of the nose end of said body, said point lying substantially on the axis of said body;

said body being formed of a billet of electrically conductive or semi-conductive material, with a slot through said billet, said slot extending through to said cylindrical body surface and extending from the back end towards said nose end of said body and terminating short of the point on said nose end so that there is continuous billet material at said nose end from one side of said slot to the other side thereof; and insulator material in said slot to support said billet on opposite sides of said slot, the point being coatable with a material suitable for ion emission and being heatable by current through said billet around said slot at the point.

8. The ion source of claim 7 wherein the nose end of said body adjacent said point is shaped to limit the area of said billet at said point to concentrate heating current under said point.

9. The ion source of claim 8 wherein said nose end of said body which extends from said front end toward said point is at least partially conical with the conical surface intersecting with the sides of the slot and with said insulator material.

10. The ion source of claim 9 wherein there is an opening in said insulator material for the insert of a temperature sensor within said body.

11. The ion source of claim 7 wherein there is an opening in said insulator material for the insert of a temperature sensor within said body.

12. The ion source of claim 7 wherein said point is integrally formed with said billet.

13. A liquid metal ion source comprising:

first and second metallic jaws, each of said jaws having a groove therein with said grooves facing each other, one of said jaws being movable with respect to the other of said jaws, said jaws being electrically insulated from each other and connectable to a heater current supply and ion current supply;

a body positioned within said grooves in said jaws and retained by said jaws, a point on said body, said body being formed of a substantially U-shaped electrically conductive or semi-conductive material having legs and a bridge connection between said legs, said legs of the U's being respectively in electrical contact with one of said jaws and with the bridge connection between said legs being adjacent said point on said body, an insulator material between the legs of said body to support said legs under the clamping force of said jaws so that as heating current passes through said U-shaped body, the point end thereof is electrically heated.

14. The liquid metal ion source of claim 13 wherein said U-shaped body is monolithically formed, and said point is monolithically formed with said body.

15. The liquid metal ion source of claim 14 wherein said insulator material fills the entire space between said legs of said body.

16. A method of forming an ion-emitting body comprising the steps of:

forming a billet of electrically conductive or semi-conductive material so that it has a point end and a back end, and sides around said billet between said ends;

slotting the billet from the back end towards the front end, from side-to-side of the billet;

placing an insulator material within the slot; and shaping a nose on the billet including shaping a point on the billet and shaping the nose so that it intersects with the insulator material so that there is a limited electrical path from one side of the slot to the other through a limited area beneath the point.

17. The method of claim 16 further including the step of shaping the sides of the billet.

18. The method of claim 16 including shaping the nose of the body in conical configuration.

19. The method of claim 18 including the step of cutting the nose with at least two cylindrical surfaces which symmetrically intersect the billet and the insulator in the slot with the axis of the cylindrical surface being normal to the slot to limit the path of electric current.

20. The method of claim 16 including the step of cutting the nose with at least two cylindrical surfaces which symmetrically intersect the billet and the insulator in the slot with the axis of the cylindrical surface being normal to the slot to limit the path of electric current and to remove the insulative material from the immediate vicinity of the point end.

* * * * *

UNITED STATES PATENT AND TRADEMARK OFFICE

CERTIFICATE OF CORRECTION

PATENT NO. : 4,638,210

DATED : January 20, 1987

INVENTOR(S) : Jerg B. Jergenson

It is certified that error appears in the above-identified patent and that said Letters Patent is hereby corrected as shown below:

On page 1 of the specification, after the title, insert --the U.S. Government has rights in this invention pursuant to Contract No. 81F-597000.--

Signed and Sealed this

Eighteenth Day of August, 1987

*Attest:*

DONALD J. QUIGG

*Attesting Officer*

*Commissioner of Patents and Trademarks*